US007626513B2

(12) United States Patent
Goodman et al.

(10) Patent No.: US 7,626,513 B2
(45) **Date of Patent: *Dec. 1, 2009**

(54) COMMUNICATION OF LANDING CONDITIONS

(75) Inventors: William L. Goodman, Coupeville, WA (US); Sayed T. Shafaat, Everett, WA (US); Thomas Imrich, Mercer Island, WA (US)

(73) Assignee: The Boeing Company, Chicago, IL (US)

( * ) Notice: Subject to any disclaimer, the term of this patent is extended or adjusted under 35 U.S.C. 154(b) by 275 days.

This patent is subject to a terminal disclaimer.

(21) Appl. No.: 11/464,642

(22) Filed: Aug. 15, 2006

(65) Prior Publication Data

US 2009/0267798 A1 Oct. 29, 2009

Related U.S. Application Data

(63) Continuation-in-part of application No. 11/461,880, filed on Aug. 2, 2006.

(51) Int. Cl.
*G08B 21/00* (2006.01)

(52) U.S. Cl. ..... 340/945; 340/971; 340/947

(58) Field of Classification Search ..... 340/971, 340/945

See application file for complete search history.

(56) References Cited

U.S. PATENT DOCUMENTS

| | | | | |
|---|---|---|---|---|
| 5,050,940 | A | 9/1991 | Bedford et al. | |
| 5,541,591 | A | 7/1996 | Bush | |
| 5,574,644 | A | 11/1996 | Butsuen et al. | |
| 5,636,123 | A | 6/1997 | Rich et al. | |
| 5,774,070 | A | 6/1998 | Rendon | |
| 5,968,106 | A | 10/1999 | DeVlieg et al. | |
| 6,278,965 | B1 | 8/2001 | Glass et al. | |
| 6,338,011 | B1 * | 1/2002 | Furst et al. | 701/1 |
| 6,381,538 | B1 * | 4/2002 | Robinson et al. | 701/211 |
| 6,469,660 | B1 * | 10/2002 | Horvath et al. | 342/179 |
| 6,650,972 | B1 | 11/2003 | Robinson et al. | |
| 6,917,860 | B1 | 7/2005 | Robinson et al. | |
| 6,952,631 | B2 * | 10/2005 | Griffith et al. | 701/13 |
| 6,991,304 | B2 | 1/2006 | Villaume | |
| 2004/0107027 | A1 * | 6/2004 | Boudrieau | 701/1 |
| 2004/0177671 | A1 * | 9/2004 | Hurson | 73/9 |
| 2006/0144997 | A1 * | 7/2006 | Schmidt et al. | 244/100 R |
| 2006/0243857 | A1 * | 11/2006 | Rado | 244/111 |
| 2007/0250224 | A1 * | 10/2007 | Dwyer | 701/16 |

OTHER PUBLICATIONS

Transport Canada—Overview of the Joint Winter Runway Friction Measurement Program, Nov. 2004 (http://www.tc.gc.ca/TDC/publication/tp13361e/menu.htm).*

(Continued)

*Primary Examiner*—Toan N Pham
*Assistant Examiner*—Kerri L McNally
(74) *Attorney, Agent, or Firm*—Rozenblat IP LLC

(57) ABSTRACT

The invention discloses differing embodiments of methods, aircraft, and apparatus for communicating the braking conditions of a runway. In one embodiment, braking information may be determined from a first aircraft which has landed on the runway. The braking information may be communicated to air traffic control and/or a second aircraft. Communication of the braking information may take place utilizing an Automatic Dependent Surveillance Broadcast system (ADS-B) and/or other type of automatic networking system.

31 Claims, 2 Drawing Sheets

OTHER PUBLICATIONS

European Search Report dated Dec. 20, 2007 in corresponding European Patent Application No. 07252944.9-1248, 5 pages.
*US FAA: Transformation of Air Traffic Control System Under Way* Copyright 2006. The Associated Press. May 2, 2006.
*Tracking System to Better Pinpoint Planes' Locations* Author: Alan Levin, USA Today; Copyright 2006. May 3, 2006.
*FAA Aims to Deploy 400 ADS-B Stations by 2014* Author: David Hughes; Aviation Week & Space Technology.
Internet Archive- Canadian Runway Friction Index—Table 1—CRFI Recommended Landing Distances—Apr. 18, 2003, (http://web.archive.org/web/20030418010005/http://wwvv.tc.gc.ca/CivilAviation/commerce/OperationalStandards/CRFI/Table1.htm).

* cited by examiner

COMMUNICATION OF LANDING CONDITIONS

RELATED APPLICATIONS

The present application claims priority from U.S. patent application Ser. No. 11/461,880, assigned to Boeing, for "The Determination Of Runway Landing Conditions" filed Aug. 2, 2006, the disclosure of which is incorporated herein by reference.

BACKGROUND OF THE INVENTION

There are existing methods and devices for communicating the braking conditions for a runway. Many of these methods and devices rely on oral communications taking place over the radio between the pilot of the landed aircraft and air traffic control, during which the pilot communicates his/her perception of the landing conditions of the runway. However, these methods and devices may be unreliable, inefficient, untimely, inconsistent, and inaccurate. This may lead to increased cost, decreased safety, lower runway efficiency, lower braking determination consistency and accuracy, and/or other types of problems.

A method, apparatus, and aircraft, is needed which may solve one or more problems in one or more of the existing methods and/or devices for communicating the braking conditions for a runway.

SUMMARY OF THE INVENTION

In one aspect of the invention, a method is disclosed for communicating the braking conditions of a runway. In one step, braking information is determined from a first aircraft which has landed on the runway. The determined braking information includes at least one of braking data, a braking performance measurement, and a normalized braking performance measurement. In another step, the braking information is communicated to at least one of air traffic control and a second aircraft.

In another aspect, the invention discloses a landed aircraft. Braking information regarding landing of the aircraft was determined and communicated to at least one of air traffic control and another aircraft. The braking information included at least one of braking data, a braking performance measurement, and a normalized braking performance measurement.

In a further aspect of the invention, an apparatus is provided which is adapted to communicate braking information regarding landing of an aircraft to at least one of air traffic control and other aircraft. The braking information includes at least one of braking data, a braking performance measurement, and a normalized braking performance measurement.

These and other features, aspects and advantages of the invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1:
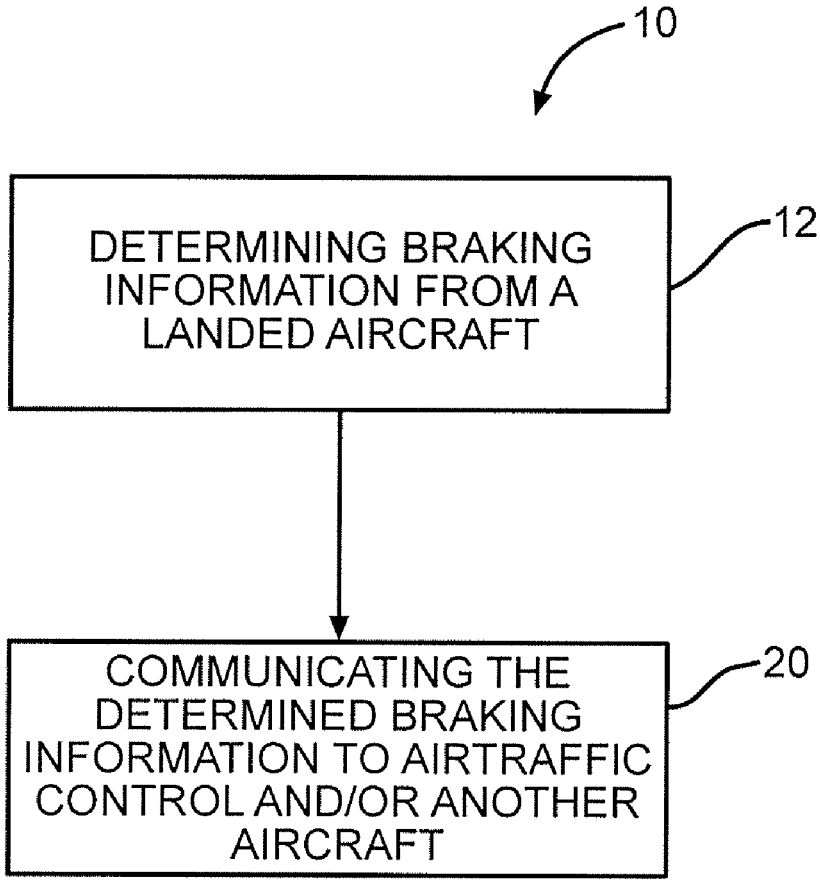
FIG. 1 depicts one embodiment of a method under the invention for communicating the braking conditions for a runway.

In one embodiment of the invention, as shown in FIG. 1, a method 10 for communicating the braking conditions for a runway is provided. In one step 12, braking information may be determined from a first aircraft which has landed on the runway. The braking information may include any information regarding the braking of the airplane on the runway. For purposes of this application, the term "aircraft" is defined as any type of device capable of flying in the air, such as an airplane or other device. The braking information may be determined utilizing an apparatus on the aircraft, such as an auto-braking apparatus, a computer, and/or other type of device. The determined braking information may include one or more of braking data, a braking performance measurement, and a normalized braking performance measurement.

Figure 2:
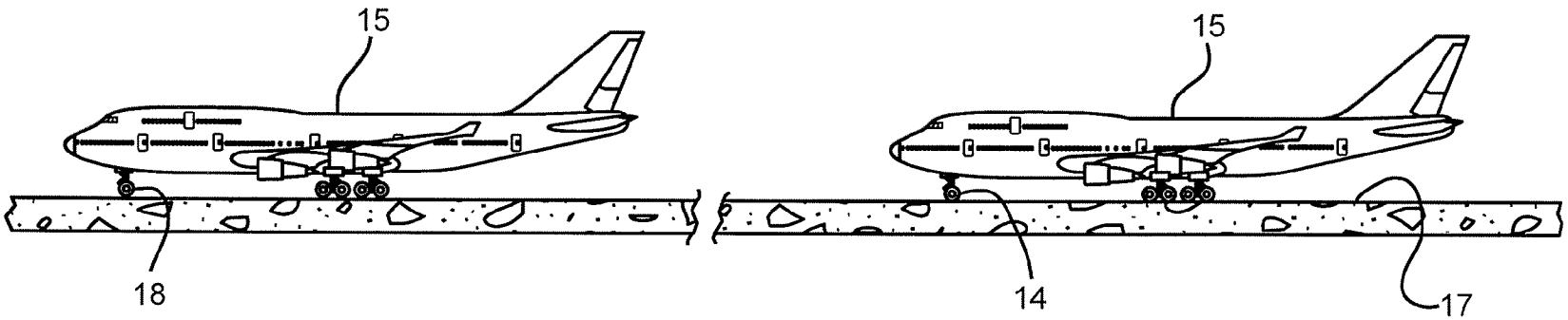
FIG. 2 depicts a perspective view of a landing aircraft (also referred to herein as a "first aircraft") in multiple locations as the aircraft touches down and proceeds down a runway.

The braking data may include any data regarding braking of the aircraft on the runway. As shown in FIG. 2, which depicts a landing aircraft 15 (also referred to as "first aircraft" and/or "landed aircraft") in multiple locations as it lands on a runway 17, the braking data may comprise an initial touch-down location 14 of the aircraft 15 on the runway 17. The initial touch-down location 14 may comprise the approximate coordinates on the runway 17 where the aircraft 15 first touches down upon landing. The collected braking data may further comprise an initial aircraft velocity of the aircraft 15 at the initial touch-down runway location 14. This initial aircraft velocity may comprise the velocity of the aircraft 15 on the runway 17 when the aircraft first touches down at the initial touch-down location 14.

Additionally, the collected braking data may comprise a final runway location 18 of the aircraft 15. The final runway location 18 may comprise the approximate coordinates on the runway 17 where the aircraft 15 has proceeded down the runway upon landing and reached a velocity where the aircraft 15 is ready to taxi off the runway 17. In another embodiment, the final runway location 18 may comprise the approximate coordinates on the runway 17 where the aircraft 15 has come to a stop and has zero velocity. In yet another embodiment, the final runway location 18 may comprise the approximate coordinates on the runway 17 of a pre-determined location. The pre-determined location may be based in part on the total length of the runway 17, or other criteria.

In addition, the collected braking data may comprise a final velocity of the aircraft 15 at the final runway location 18. The final velocity may comprise the velocity of the aircraft 15 at the final runway location 18. The final velocity may comprise a velocity on the runway 17 when the aircraft 15 has reached a velocity where it is ready to taxi off the runway 17. In another embodiment, the final velocity may comprise a zero velocity when the aircraft 15 has come to a stop. In still another embodiment, the final velocity may comprise the velocity of the aircraft 15 on the runway 17 at the above-referenced pre-determined location.

The braking performance measurement may comprise a measurement of the braking performance of the aircraft on the runway. The braking performance measurement may be determined for the landed aircraft 15 based on the collected braking data. The braking performance measurement may comprise calculating one or more runway deceleration measurements of the landed aircraft 15. The runway deceleration measurement may comprise the deceleration of the landed aircraft 15 between the initial touch-down location 14 on the runway 17 and the final runway location 18. The deceleration measurement may be calculated by using a mathematical formula similar to the formula Deceleration=|((Velocity 2)$^2$−(Velocity 1)$^2$)/(2*Distance)|, wherein Velocities 1 and 2 represents the respective velocities of the aircraft 15 at two separate locations along the runway 17, and the Distance represents the distance along the runway 17 between the respective locations where Velocities 1 and 2 are measured. The deceleration measurement may be taken in feet per second squared. In one embodiment, the deceleration may be calculated between the initial touch-down location 14 and the final runway location 18 by using, in the above Deceleration formula, the initial aircraft velocity as Velocity 1, the final aircraft velocity as Velocity 2, and the runway distance between the initial touch-down location 14 and the final runway location 18 as the Distance.

In other embodiments, the deceleration measurement may comprise calculating the deceleration of the aircraft 15 at several different locations along the runway 17. This iteration and calculation may be in the order of twenty times per second. In other embodiments, any number of deceleration measurements may be taken. A graph and/or dynamic display may be prepared to show the variation in deceleration of the aircraft 15 after it touches down 14 until it comes to its final runway location 18. In other embodiments, only one deceleration measurement may be taken. In still other embodiments, the deceleration measurement may be taken along different portions of the runway 17.

The normalized braking performance measurement may comprise a normalized value of the braking performance measurement. The normalized braking performance measurement may be determined based on the calculated braking performance measurement of the landed aircraft 15. The normalized braking performance measurement may comprise the expected braking performance on the runway 17 of a standard aircraft on a standard day. The term "standard aircraft" may represent a generic, non-descript aircraft of no particular type, while the term "standard day" may represent a day having normal landing conditions. In one embodiment, a standard day may comprise a day where the temperature is 59 degrees Fahrenheit, having a 29.92 Altimeter setting, with no wind, and at sea level. The normalized braking performance measurement may represent a normalization of one or more deceleration rates of the aircraft 15 on the runway 17. The normalized braking performance measurement may comprise an index, coefficient, or value used to represent the expected braking ability of a generalized aircraft on the runway 17.

In determining the normalized braking performance measurement, a variety of factors may be taken into account in order to normalize the calculated braking performance measurement to that of a standard aircraft. Some of these factors may include consideration of wind speed, wind direction, weight of the aircraft, type of the aircraft, air temperature, configuration of the aircraft, Minimum Equipment List (MEL) conditions, thrust reverse conditions, non-normal conditions, initial aircraft velocity at the initial touch-down runway location, final aircraft velocity at the final runway location, and/or other factors.

In another step 20 of method 10, the determined braking information 12 may be communicated to one or more of air traffic control and a second aircraft. The second aircraft may comprise an incoming aircraft which is contemplating landing on the runway. The determined braking information 12 may be communicated 20 utilizing an Automatic Dependent Surveillance Broadcast system (ADS-B) and/or other type of automatic networking system which networks information from a first aircraft to air traffic control and/or a second aircraft.

An ADS-B system which may be used to communicate 20 the determined braking information 12 may be satellite-based. The ADS-B system may include a Cockpit Display of Traffic Information (CDTI) that may show the aircraft's precise location using a Global Positioning system. Once per second, a transponder may send the location information from the aircraft to all users. In one embodiment, one or more antenna may be attached to a cell-phone tower, which may relay the received braking information to air traffic control. For purposes of this application, the term "air traffic control" may include any device, apparatus, or other system which aids in directing, informing, keeping track of, and/or controlling air traffic.

Using an ADS-B system, pilots of aircraft equipped with CDTI may be able to view a similar visual display in the cockpit as air traffic controllers see on the ground showing the aircraft's precise location as well as the weather, location of other aircraft nearby, and landing aircraft braking information. The use of this system may allow aircraft to fly closer together than current radar systems, since the system may be more precise and may allow pilots to see for themselves exactly where their aircraft is with respect to other aircraft in their airspace. As a result, more aircraft may be able to fly in the same airspace at the same time, thereby potentially saving cost, time, and/or being more efficient. Additionally, the components of the ADS-B system may be less expensive than existing radar systems. Moreover, the ADS-B system may allow the tracking of low flying aircraft which may not be visible on radar.

The determined and/or communicated braking information 12 and 20 may be displayed on a dynamic display, such as on a monitor, computer, and/or other type of display system. The dynamic display may be located in air traffic control, and/or in the second aircraft (non-landed aircraft), and may show braking information 12 at particular locations over the runway. These dynamic displays may allow air traffic control and/or the second aircraft to determine the runway deceleration conditions on a continuing time spectrum along various portions of the runway 17 for varying numbers and types of aircraft. The display may show a graph and/or may display the information in other manners. The dynamic display may show braking information for multiple landed aircraft.

In another step, an expected braking performance of the second aircraft (non-landed aircraft) on the runway may be determined based on the braking information received from the first landed aircraft. The expected braking performance may take into account particular information regarding the type of the second aircraft in order to estimate its expected braking performance. The expected braking performance may be based on the normalized braking performance measurement of the landed aircraft. This may be achieved by taking into account the configuration, weight, and performance capabilities of the particular second aircraft. In such manner, the expected braking performance of a whole host of different aircraft may be determined. A decision as to whether the second aircraft should land on the runway may be made based on the braking information of the first aircraft and/or on the expected braking performance of the second aircraft.

In another step, a minimum standard sustainable deceleration rate may be assigned for continued operation of the runway 17 in hazardous weather conditions. A decision may be made as to whether to shut down the runway 17 due to hazardous conditions by comparing the braking information of the first aircraft to the assigned minimum sustainable deceleration rate. If the braking information is below the assigned minimum sustainable deceleration rate for the runway 17, the runway 17 may be shut down until conditions improve.

Any of the above referenced steps for any of the disclosed method embodiments may utilize one or more apparatus located on the first and/or second aircrafts. Such apparatus may comprise one or more computers, and/or other types of devices.

In another embodiment, the invention may comprise a landed aircraft on a runway. Braking information regarding landing of the aircraft may have been determined. The determined braking information may have included one or more of braking data, a braking performance measurement, and a normalized braking performance measurement. The determined braking information may have been communicated to air traffic control and/or another aircraft. Any of the embodiments disclosed herein may have been utilized during landing of the aircraft in order to determine and communicate the braking information.

In yet another embodiment, the invention may comprise an apparatus which is adapted to communicate braking information regarding landing of the aircraft to air traffic control and/or other aircraft. Such braking information may include one or more of braking data, a braking performance measurement, and a normalized braking performance measurement. Any of the embodiments disclosed herein may be used as part of the apparatus to communicate the braking information.

One or more embodiments of the disclosed invention may solve one or more problems in existing methods, aircraft, and apparatus for communicating the braking conditions of a runway. One or more embodiments of the invention may provide a communicated, substantially real-time, quantitative, definitive, and/or reliable measure of runway landing conditions. In such manner, the invention may decrease cost, increase safety, increase runway efficiency, increase braking determination consistency and accuracy, and/or address other problems known in the art. For instance, the invention may aid in the determination of runway/airport plowing and closure decisions, may aid in rejected takeoff decisions, may aid in airline dispatch, may aid in flight crew divert decisions, and/or may aid in other problem areas.

It should be understood, of course, that the foregoing relates to exemplary embodiments of the invention and that modifications may be made without departing from the spirit and scope of the invention as set forth in the following claims.

We claim:

1. A method for communicating the braking conditions for a runway comprising:

determining braking information in real-time from a first aircraft landing on the runway using an automated apparatus on the first aircraft comprising at least one computer, wherein said braking information comprises at least one of (1) a real-time braking performance measurement comprising at least one runway real-time deceleration measurement of the landing first aircraft based on an initial touch-down runway location of said first aircraft, an initial velocity of said first aircraft at said initial touch-down runway location, a final runway location of said first aircraft, and a final velocity of said first aircraft at said final runway location, and (2) a real-time normalized braking performance measurement comprising an expected braking performance of a standard aircraft on said runway, the real-time normalized braking performance measurement further comprising the normalization of a real-time deceleration rate of the landing first aircraft which takes into account at least one of wind speed, wind direction, a weight of the first aircraft, a type of the first aircraft, air temperature, configuration of the first aircraft, Minimum Equipment List conditions, thrust reverse conditions, non-normal conditions, the initial velocity of said first aircraft at the initial touchdown runway location, and the final velocity of said first aircraft at the final runway location;

communicating in real-time said real-time braking information to at least one of air traffic control and a second aircraft, comprising an incoming aircraft, utilizing at least one of an Automatic Dependent Surveillance Broadcast system (ADS-B) and an automatic networking system; and determining in real-time the expected braking performance of said second aircraft on said runway based on said real-time braking information.

2. The method of claim 1 further comprising the step of determining whether said second aircraft should land on said runway based on said real-time expected braking performance of said second aircraft.

3. The method of claim 1 further comprising the step of preparing a dynamic display showing said braking information.

4. The method of claim 3 wherein said dynamic display shows braking information for multiple landing aircraft.

5. The method of claim 3 wherein said dynamic display shows said braking information in at least one of said air traffic control, and said second aircraft.

6. The method of claim 1 further comprising the step of determining whether the runway should be shut down due to hazardous conditions based on said braking information.

7. The method of claim 1 wherein said final runway location comprises at least one of a location where said first aircraft is ready to taxi off said runway, a pre-determined location on said runway, and a location where said first aircraft is stopped.

8. The method of claim 7 wherein said pre-determined location on said runway is based, at least in part, on a length of said runway.

9. The method of claim 1 wherein said apparatus further comprises an auto-braking apparatus.

10. The method of claim 1 wherein the step of determining the braking information comprises determining said braking performance measurement.

11. The method of claim 1 wherein the step of determining the braking information comprises determining said normalized braking performance measurement.

12. The method of claim 11 wherein said standard aircraft represents a generic, non-descript aircraft.

13. The method of claim 1 wherein the step of determining the braking information comprises determining said normalized braking performance measurement which further represents the expected braking performance of the standard aircraft on a standard day on said runway.

14. The method of claim 13 wherein said standard day represents a day with normal landing conditions.

15. The method of claim 1 wherein the step of communicating said braking information comprises the first aircraft communicating said braking information directly to the second aircraft.

16. The method of claim 1 wherein said braking information comprises both the real-time braking performance measurement and the real-time normalized braking performance measurement.

17. A landed aircraft wherein braking information regarding landing of said aircraft was determined in real-time using an automated apparatus on the landed aircraft comprising at least one computer and said braking information was communicated in real-time utilizing at least one of an Automatic Dependent Surveillance Broadcast system and an automatic networking system to at least one of air traffic control and another landing aircraft, and an expected braking performance of the another landing aircraft was determined based on said braking information, wherein said braking information comprised at least one of: (1) a real-time braking performance measurement comprising at least one runway deceleration measurement of the landed aircraft based on the initial touch-down runway location of the landed aircraft, an initial velocity of the landed aircraft at the initial touch-down runway location, a final runway location of the landed aircraft, and a final velocity of the landed aircraft at the final runway location, and (2) a real-time normalized braking performance measurement comprising the normalization of a deceleration rate of the landed aircraft representing the expected braking performance of a standard aircraft on the runway taking into account at least one of wind speed, wind direction, a weight of the landed aircraft, a type of the landed aircraft, air temperature, configuration of the landed aircraft, Minimum Equipment List conditions, thrust reverse conditions, non-normal conditions, the initial velocity of the landed aircraft at the initial touchdown runway location, and the final velocity of the landed aircraft at the final runway location.

18. The landed aircraft of claim 17 wherein said apparatus further comprised an auto-braking apparatus.

19. The landed aircraft of claim 17 wherein a decision as to whether it was safe to land said another landing aircraft was made based on said braking information.

20. The landed aircraft of claim 19 wherein the decision as to whether it was safe to land said another landing aircraft was made based on said braking information received on board said another landing aircraft utilizing a Cockpit Display of Traffic Information system (CDTI).

21. The landed aircraft of claim 17 wherein said braking information was displayed on a dynamic display.

22. The method of claim 17 wherein said braking information comprised the braking performance measurement.

23. The method of claim 17 wherein said braking information comprised the normalized braking performance measurement.

24. The landed aircraft of claim 17 wherein the braking information was communicated directly from the landed aircraft to the another landing aircraft.

25. The landed aircraft of claim 17 wherein said braking information comprises both the real-time braking performance measurement and the real-time normalized braking performance measurement.

26. An apparatus for determining and communicating braking information in real-time regarding landing of an aircraft on a runway to at least one of air traffic control and another landing aircraft in order to determine an expected braking performance of the another landing aircraft on the runway based on said braking information, wherein said apparatus comprises at least one automated computer and at least one of an Automatic Dependent Surveillance Broadcast system and an automatic networking system, and wherein said braking information comprises at least one of a (1) real-time braking performance measurement comprising at least one runway deceleration measurement of the landing aircraft based on an initial touch-down runway location of the landing aircraft, an initial velocity of the landing aircraft at the initial touch-down runway location, a final runway location of the landing aircraft, and a final velocity of the landing aircraft at the final runway location, and (2) real-time normalized braking performance measurement comprising the normalization of a deceleration rate of the landing aircraft representing the expected braking performance of a standard aircraft on the runway taking into account at least one of wind speed, wind direction, a weight of the landing aircraft, a type of the landing aircraft, air temperature, configuration of the landing aircraft, Minimum Equipment List conditions, thrust reverse conditions, non-normal conditions, the initial velocity of the landing aircraft at the initial touchdown runway location, and the final velocity of the landing aircraft at the final runway location.

27. The apparatus of claim 26 wherein said apparatus further comprises a Cockpit Display of Traffic Information (CDTI) system.

28. The apparatus of claim 26 wherein the braking information comprises said braking performance measurement.

29. The apparatus of claim 26 wherein the braking information comprises said normalized braking performance measurement.

30. The apparatus of claim 26 wherein the apparatus communicated the braking information directly from the landing aircraft to the another landing aircraft.

31. The apparatus of claim 26 wherein said braking information comprises both the real-time braking performance measurement and the real-time normalized braking performance measurement.

* * * * *